United States Patent [19]

Sobolik

[11] 4,026,340

[45] May 31, 1977

[54] DEVICE FOR HOLDING A BAG MOUTH OPEN

[76] Inventor: Daryl A. Sobolik, 242 Santa Fe Drive, Walnut Creek, Calif. 94598

[22] Filed: May 28, 1976

[21] Appl. No.: 691,101

[52] U.S. Cl. ..... 150/48; 150/1

[51] Int. Cl.[2] ..... B65D 33/02

[58] Field of Search ..... 150/1, 48, 49, 51; 248/99, 101; 46/47

[56] References Cited

UNITED STATES PATENTS

| | | | |
|---|---|---|---|
| 1,173,755 | 2/1916 | Straight | 150/48 |
| 1,961,947 | 6/1934 | Sieling | 150/48 |
| 2,738,616 | 3/1956 | Windle | 428/13 X |
| 3,035,623 | 5/1962 | Goetz | 150/48 |
| 3,893,649 | 7/1975 | Cornell | 248/99 |

FOREIGN PATENTS OR APPLICATIONS

| | | | |
|---|---|---|---|
| 649,021 | 9/1962 | Canada | 46/47 |
| 1,215,865 | 11/1959 | France | 46/47 |
| 1,217,940 | 12/1959 | France | 46/47 |

*Primary Examiner*—Donald F. Norton

*Attorney, Agent, or Firm*—Townsend and Townsend

[57] ABSTRACT

A continuous, relatively stiff ring capable of being coiled to form at least a pair of adjacent, generally circular loops of substantially the same size, about which the mouth of a flexible bag may be tucked as the loops are rolled over one another several times to, in turn, cause the bag mouth to be rolled a number of times about the loops and to be captured thereby, so that the loops hold open the bag mouth.

8 Claims, 6 Drawing Figures

DEVICE FOR HOLDING A BAG MOUTH OPEN

This invention relates particularly to devices which spread and hold open the mouth of a flexible bag to facilitate filling the bag.

DESCRIPTION OF THE PRIOR ART

Presently on the market, and enjoying great commercial success are trash bags which are fabricated from a highly flexible, thin-walled, tough plastic material. Such bags are ideally suited for holding and transporting a variety of items—not the least of which is general household or yard trash. Many such bags are quite large, at times measuring 5 to 6 feet in length with the mouth or opening of the bag being about 2½ feet in diameter. One drawback to these bags, however, is that because of their high flexibility, the mouths of these bags are difficult to hold open and, while so held, filled by one person. Thus, filling these bags is, at times, a singularly frustrating experience.

Some attempts to remedy this problem have resulted in bag holders of a variety of shapes and sizes. Many presently available bag holders are provided with stands, are heavy or unwieldy, or are of such complex design that their cost of manufacture works against general public acceptance. Just about any of these factors will work against the use of such conventional bag holders for general use in a household or the like. Thus, a need has arisen for a bag holder that is simple in construction, inexpensive to produce, easy to use, and capable of being conveniently and easily stored.

SUMMARY OF THE INVENTION

The present invention satisfies the aforementioned need by providing a portable and easy-to-use bag holder comprising an elongate, thin, relatively stiff member, the ends of which are joined to form a continuous ring. The member is capable of being doubled upon itself or coiled to form at least generally adjacent circular loops. Preferably, the diameter of the loops so formed will be no greater than the approximate diameter of the mouth of the type bag described above, with which the bag holder will be used. The mouth portion of the bag, after being passed through the loops, may then be tucked about the loops by rolling the loops a number of times about each other so that the fingers of the hand guide, roll, and tuck the bag mouth portion about the loops. Thus, the material of the mouth of the bag becomes coupled in a rolled relationship about the loops of the holder and is effectively prevented from being unrolled without reversing the above steps. The device, although sufficiently flexible to permit the coiling and rolling described above, is sufficiently stiff to hold the bag mouth in an open position.

As can be seen, a number of advantages are readily achieved by the bag holder of the present invention. First, the bag holder is simple and rugged in construction, extremely portable, light, and easy to use and manufacture. Second, the holder is usable for bag mouths of a variety of diameters, as will be more specifically described herein. Moreover, the thin profile of the bag holder allows it to be conveniently and readily stored when not in use.

For a fuller understanding of the nature and advantages of the present invention, reference should be had to the ensuing detailed description taken in conjunction with the accompanying drawings.

DETAILED DESCRIPTION OF THE PREFERRED EMBODIMENT

Figure 1:
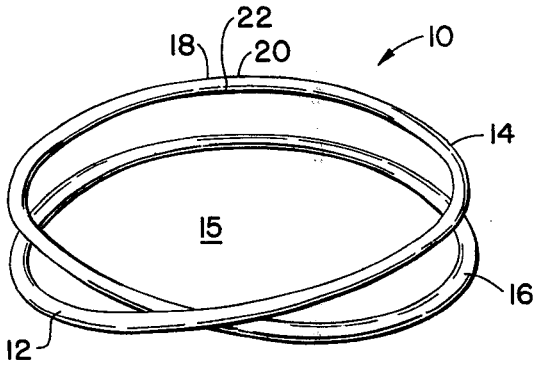
FIG. 1 is a perspective view of the bag holder of the present invention.

Turning now to the drawings, a bag holder, generally designated by reference numeral 10, is shown as including an endless, flexible member 12 that is generally circular in cross-section. One form of the member 12 could be elongated and tubular and capable of receiving a plug (not shown) in the ends 18 and 22 to releasably join them together at junction 22, as shown in FIG. 1, to render the member 12 endless. Other means to join the ends can be used, if desired, such as welding, molding, or the like. With the ends 18 and 20 joined together at 22, member 12 is coiled to form two loops 14 and 16. Although flexible, the holder 10 possesses sufficient rigidity so that the loops retain a generally circular configuration that is deformable if desired.

While member 12 is shown as a single length of material, it can also be made up of several, releasably interconnected sections, if desired. By making member 12 sectional, the size of the loops can be increased or decreased to accommodate bag mouth diameters of different sizes. Alternatively, member 12 can be made to form more than two loops to, again, adapt the device 10 for use in bag mouths of smaller diameter.

Figure 2:
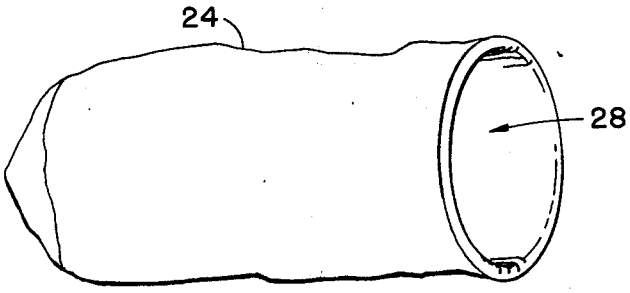
FIG. 2 is a perspective view of a bag with the holder of the present invention in place to hold open the bag mouth.

Bag holder 10, so formed, thereby provides a structural support about which the mouth of a thin walled, plastic trash bag may be tucked to hold the bag mouth open as illustrated in FIG. 2. As pointed out above, it is presently contemplated that bags to be used with this invention are fabricated from a flexible plastic material which, although tough, can be subject to being torn or otherwise perforated by sharp protrusions. Therefore, the outer surface of the member 12 is preferably of a smooth configuration that is absent sharp corners of edges to obviate cutting or tearing of the bag during use. Thus, member 12, which may be fabricated from polyvinyl or the like, is shown as having a generally circular cross-section (FIG. 3) although any other section devoid of edges and corners may also be used.

Figure 3A:
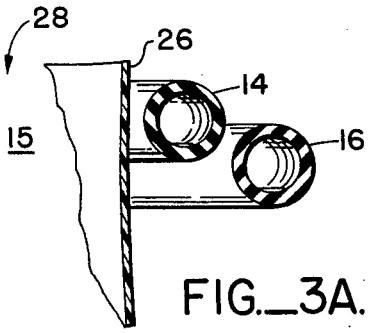
FIGS. 3A–3D are enlarged fragmentary cross-sectional views of the holder and a bag, showing the sequence of coupling the holder to the mouth of a bag.
Figure 3C:
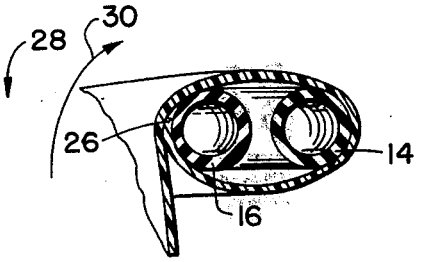
Figure 3B:
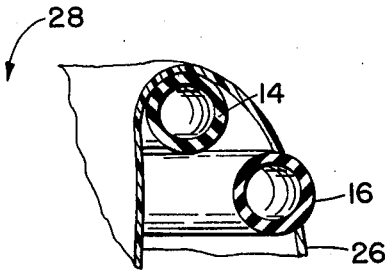
Figure 3D:
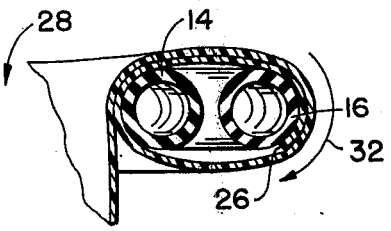

Referring now to FIGS. 3A–3D, use of the bag holder 10 may be more specifically described. Although there are a variety of methods that may be utilized to wrap or otherwise tuck the end material 26 of bag mouth 28 about loops 14 and 16 of holder 10, FIGS. 3A–3D illustrate one method found to be ideally suited to the present invention. As shown in FIG. 3A, end material 26 of the bag mouth is inserted through the center area 15 surrounded by loops 14 and 16 of the holder; center area 15 of the holder 10 would be to the left of loops 14 and 16 in the subject figures (FIGS. 3A–3D). The bag mouth end material 26 is then folded outward, away from the center area of the holder and about the loops (FIG. 3B) around the entire perimeter of the holder. Loop 14 is rolled in a direction away from center area 15 and over loop 16 in the direction of arrow 30 (FIG. 3C). This rolling motion is continued, as indicated by arrow 32 of FIG. 3D, to roll the loops 14 and 16 about one another a number of times. This rolling of the loops acts to guide the fingers of the user to roll and tuck the bag about the loops, which thereby capture and hold the bag thereabout. The material of bag 24 is now securely wrapped about bag holder 10 so that the holder 10 holds mouth 28 open in the configuration illustrated in FIG. 2.

As indicated in the figures, appropriate placement of bag holder 10 in mouth 28 of bag 24 allows the opening created thereby to be held by a user in one hand. Thus, the remaining hand is left free to gather articles for filling the bag 28.

As is now apparent, a bag holder fabricated in accordance with the teachings of the present invention results in a device that is of simple and rugged construction, relatively inexpensive to manufacture, and simple to use. The uncomplicated construction and light weight provide the user with a holder that may be adapted for use with a variety of bags. Moreover, the structure of the present invention is ideally suited for convenient storage.

While the above provides a full and complete disclosure of the present invention, various modifications, alternate constructions, and equivalents may be employed without departing from the true spirit and scope of the invention. Therefore, the above description and illustrations should not be construed as limiting the scope of the invention which is defined by the appended claims.

I claim:

1. Apparatus comprising:

a flexible bag having a mouth portion; and an endless member defining a continuous ring coiled to form at least two adjacent and overlapping, generally circular loops adapted to receive said bag mouth, the bag mouth being wrappable about the loops when the loops are rolled about each other a number of times to releasably couple the bag mouth to the member, said member provided with sufficient rigidity so that said bag mouth is held in an open position.

2. The apparatus of claim 1, wherein the member is plastic.

3. The apparatus of claim 1, wherein said member includes a generally smooth outer surface.

4. The apparatus of claim 3, wherein the member is annular in cross-section.

5. The apparatus of claim 1, wherein said member is initially elongated to present a pair of opposed ends, and including means coupled with the ends for joining the same.

6. The apparatus of claim 5, wherein the ends are releasably joined.

7. The apparatus of claim 5, wherein the member is composed of a number of releasably interconnected sections.

8. In combination:

a flexible bag having a mouth portion defining an opening;

an elongate member having a generally annular cross-section and opposed ends; and means coupled to at least one of the ends for releasably joining said ends to form a continuous ring capable of being coiled to form at least two adjacent, generally circular loops having the mouth portion inserted therethrough and wrapped thereabout by rolling the loops about each other a number of times to releasably capture said mouth portion to said loops, said member provided with sufficient rigidity to hold said opening in an open position when said mouth portion is releasably coupled to said member.

* * * * *